US010991197B2

(12) United States Patent
Sakamoto et al.

(10) Patent No.: US 10,991,197 B2
(45) Date of Patent: Apr. 27, 2021

(54) GAME MACHINE SYSTEM

(71) Applicant: JT CO., LTD., Nagoya (JP)

(72) Inventors: Hidehiko Sakamoto, Nagoya (JP); Jong Hak Choi, Seoul (KR); Hideo Takeda, Tokyo (JP); Hiroaki Kashima, Tokyo (JP)

(73) Assignee: JT CO., LTD., Nagoya (JP)

( * ) Notice: Subject to any disclaimer, the term of this patent is extended or adjusted under 35 U.S.C. 154(b) by 254 days.

(21) Appl. No.: 16/264,033

(22) Filed: Jan. 31, 2019

(65) Prior Publication Data

US 2020/0043283 A1 Feb. 6, 2020

(30) Foreign Application Priority Data

Aug. 3, 2018 (JP) ..... JP2018-146553

(51) Int. Cl.
*G07F 17/32* (2006.01)

(52) U.S. Cl.
CPC ..... *G07F 17/3223* (2013.01); *G07F 17/3213* (2013.01); *G07F 17/3216* (2013.01); *G07F 17/3239* (2013.01); *G07F 17/3262* (2013.01); *G07F 17/3293* (2013.01)

(58) Field of Classification Search
CPC ..... G07F 17/3223; G07F 17/3213; G07F 17/3216; G07F 17/3239; G07F 17/3262; G07F 17/3293
See application file for complete search history.

(56) References Cited

U.S. PATENT DOCUMENTS 5,775,993 A * 7/1998 Fentz ..... G07F 17/3262 463/17
2006/0116187 A1* 6/2006 Johnson ..... G07F 17/3211 463/16

(Continued)

FOREIGN PATENT DOCUMENTS

JP 2011-92719 A 5/2011

OTHER PUBLICATIONS

Applicant published a pamphlet entitled "Fortune Guardians" in 2018 for distributing at ICE Totally Gaming, Excel London (Royal Victoria Dock, 1 Western Gateway, London E16 1XL, UK) during Feb. 6 through 8, 2018 and at G2E Asia (G2E: Global Gaming Expo) Venetian Macau Convention & Exhibition Center (Estrada da Baia de Nossa Senhora da Esperanca, Macau) during May 15 through 17, 2018.

*Primary Examiner* — David L Lewis
*Assistant Examiner* — Shauna-Kay Hall
(74) *Attorney, Agent, or Firm* — Ken ichiro Yoshida; Yoshida & Associates LLC

(57) ABSTRACT

Provided is a game machine system including a game machine capable of progressing different kinds of games and a table games with different kinds of the games, the game machine system including an administration controller connected to a plurality of game machines and the game machine capable of displaying progress of a game selected from a plurality of kinds of games and a result of the game, in which the game machine includes an operating device with which a player operates the progress of the game, and the progress of the game connected to the administration controller is performed by operation of the operating device of the game machine selected by the administration controller.

16 Claims, 12 Drawing Sheets

(56) References Cited

U.S. PATENT DOCUMENTS

| | | | | |
|---|---|---|---|---|
| 2006/0205470 | A1* | 9/2006 | Parent | A63F 5/00 463/16 |
| 2008/0176657 | A1* | 7/2008 | Okada | G07F 17/32 463/42 |
| 2009/0181748 | A1* | 7/2009 | Nagano | G07F 17/32 463/17 |
| 2009/0325684 | A1* | 12/2009 | Wudtke | G07F 17/32 463/21 |
| 2019/0051102 | A1* | 2/2019 | Atkinson | G07F 17/3211 |

* cited by examiner

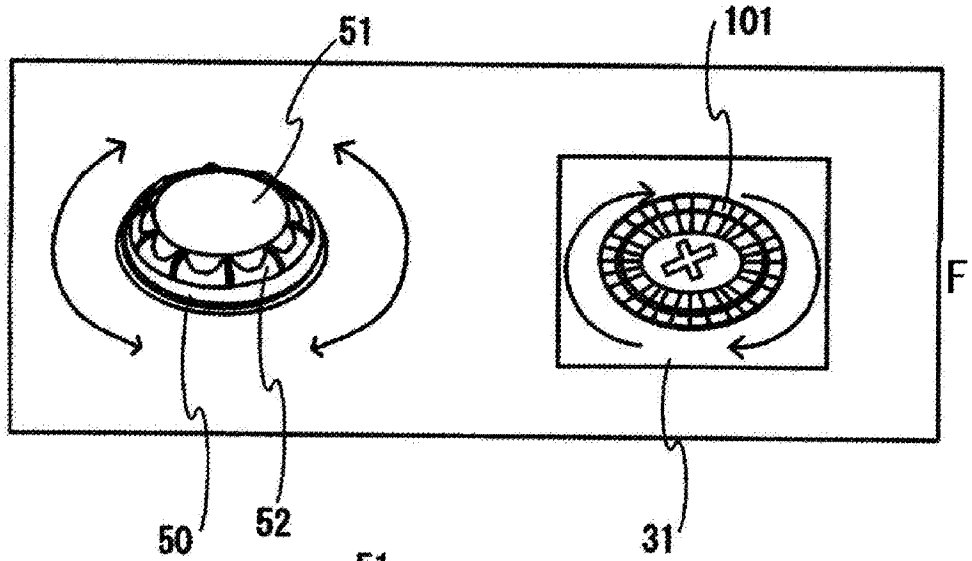
FIG. 9A
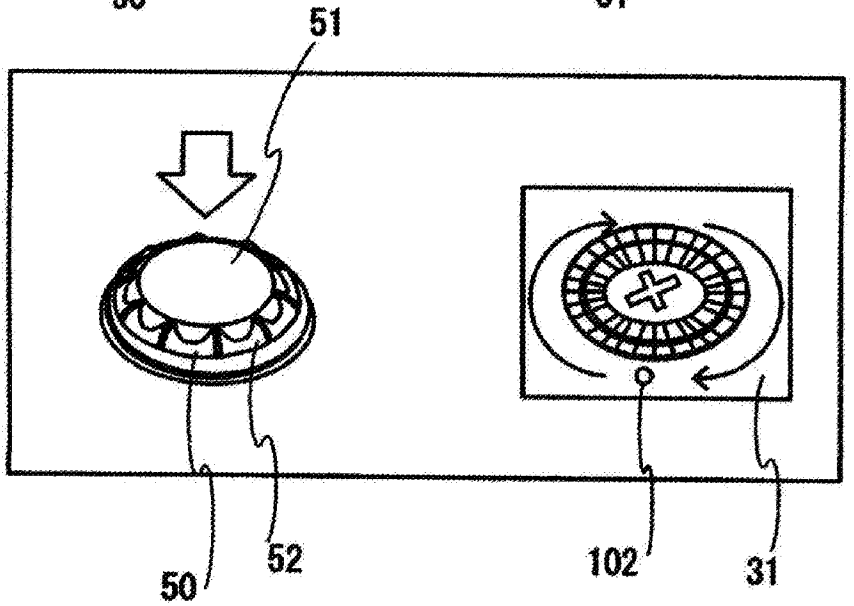
FIG. 9B
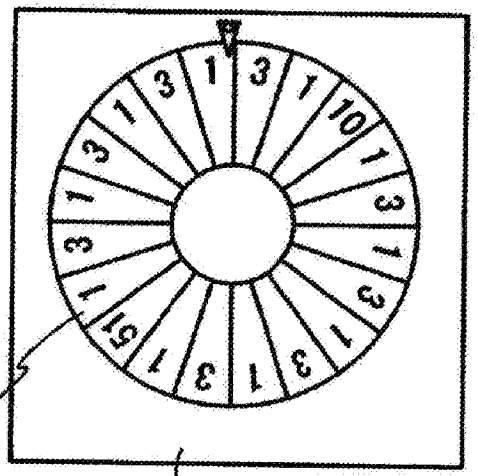
3
1
10
1
3
1
3
1
3

GAME MACHINE SYSTEM

BACKGROUND OF THE INVENTION

(1) Field of the Invention

The present invention relates to a game machine system integrating game machines such as slot machines and video slot machines that are used in game parlors such as casinos.

(2) Description of Related Art

Conventionally, there is a game machine called a video slot, which is superior to conventional mechanical slot machines in that it can stimulate players through visual effects with video and animation.

With a bit of ingenuity, such visual expression on video may provide an exciting game to players. Especially, expressions applying software technology using animation include various expressions to live up a game as entertainment, and can attract players.

For example, the game machine described in JP 2011-92719 A has a display portion and a controller. The display portion displays a specific symbol placed in a specific cell. The symbol contains a specific type of symbol that is placed in the specific cell. The controller controls movements of the symbols and cells. The specific cell has a gauge. A numerical value indicated by the gauge represents a count of how many times the specific cell appears in the display portion. The controller compares the numerical value of the gauge with a threshold value, and sets a favorable condition to a player to be initiated when the value of the gauge has reached the threshold value.

Patent document 1 JP2011-92719 A

SUMMARY OF THE INVENTION

However, in conventional game machines, it has been ended that a player has only waited for the game result while having watched expression of animation appearing on a display portion. Thus, the player has no element that can participate in the game while involving himself with the game result expressed for a long period of time, but only a sense of expectation of waiting for the result. The player may often expect expression that maintains a sense of expectation and game performance by a performance even when the player waits for a long period of time until the game result comes out.

An object of the present invention is to provide a game machine system which allows a player to participate in a game until a game result comes out so as not to bore the player even for a period of time during which the game result comes out, and which achieves such a performance that maintains a sense of expectation for the game result.

The present invention provides a game machine system comprising a game machine capable of progressing different kinds of games and a table game with different kinds of the games, the game machine system comprising an administration controller connected to a plurality of game machines and the game machine capable of displaying progress of a game selected from a plurality of kinds of games and a result of the game, wherein the game machine includes an operating device with which a player operates the progress of the game, and the progress of the game at a place different from the game machine selected by the administration controller is performed by operation of the operating device of the game machine selected by the administration controller.

With the above characteristics, the player is encouraged to push such an operating device, so that the player can participate in and enjoy the game. In addition, the player can join other games even when the player is away.

BRIEF DESCRIPTION OF THE DRAWINGS

FIGS. 9A to 9D each show a display image of a display portion of a game machine for illustrating Example 4 of the embodiment;

DETAILED DESCRIPTION OF PREFERRED EMBODIMENTS

Embodiments

A game machine system 1 according to the present invention will be described in detail with reference to the drawings. The following embodiments and drawings illustrate some of the embodiments of the present invention and are not intended to limit the present invention. Various modifications can be made within the scope of the present invention.

Figure 1:
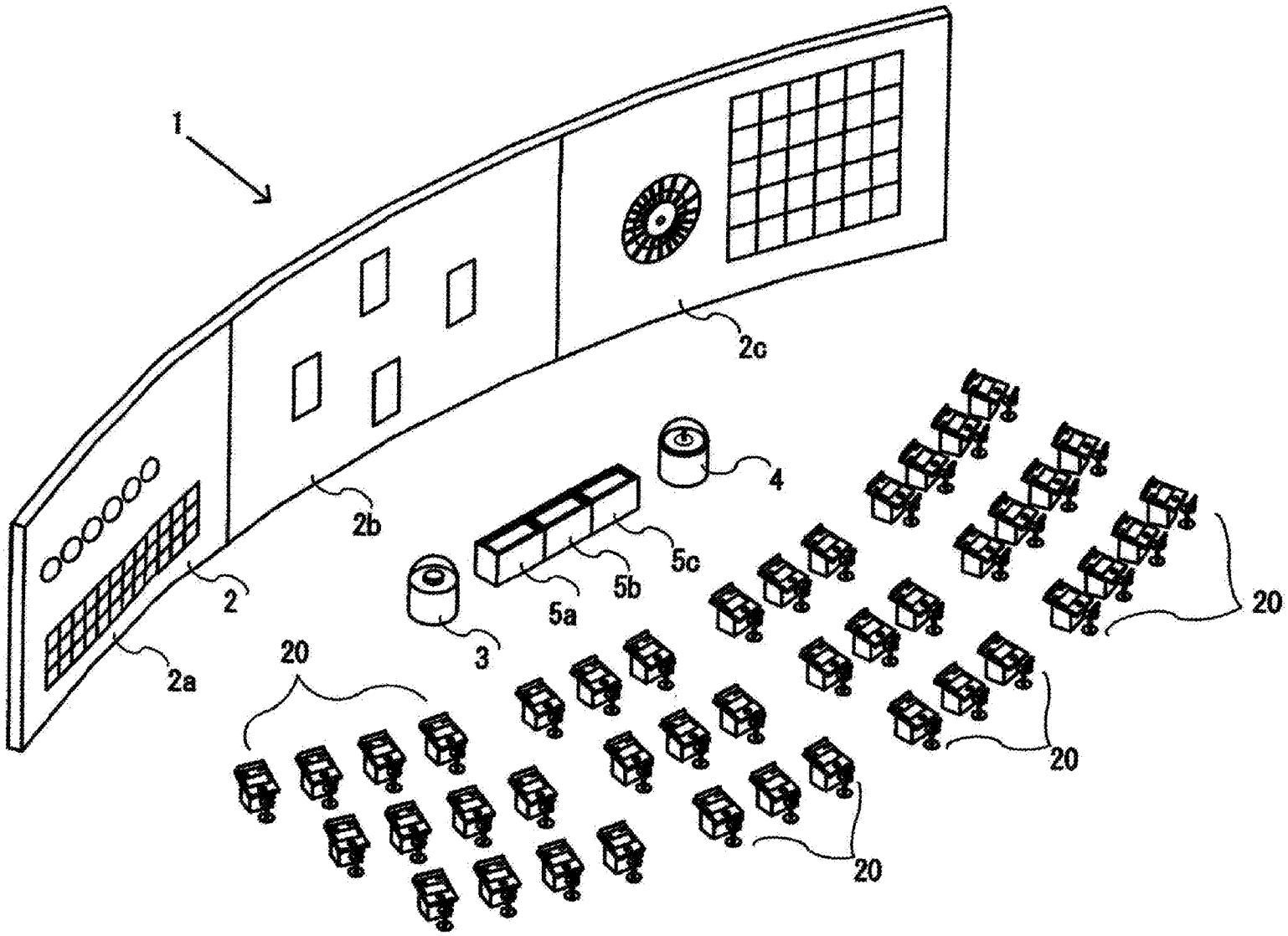
FIG. 1 is an entire schematic perspective view of a game machine system according to an embodiment.
Figure 2:
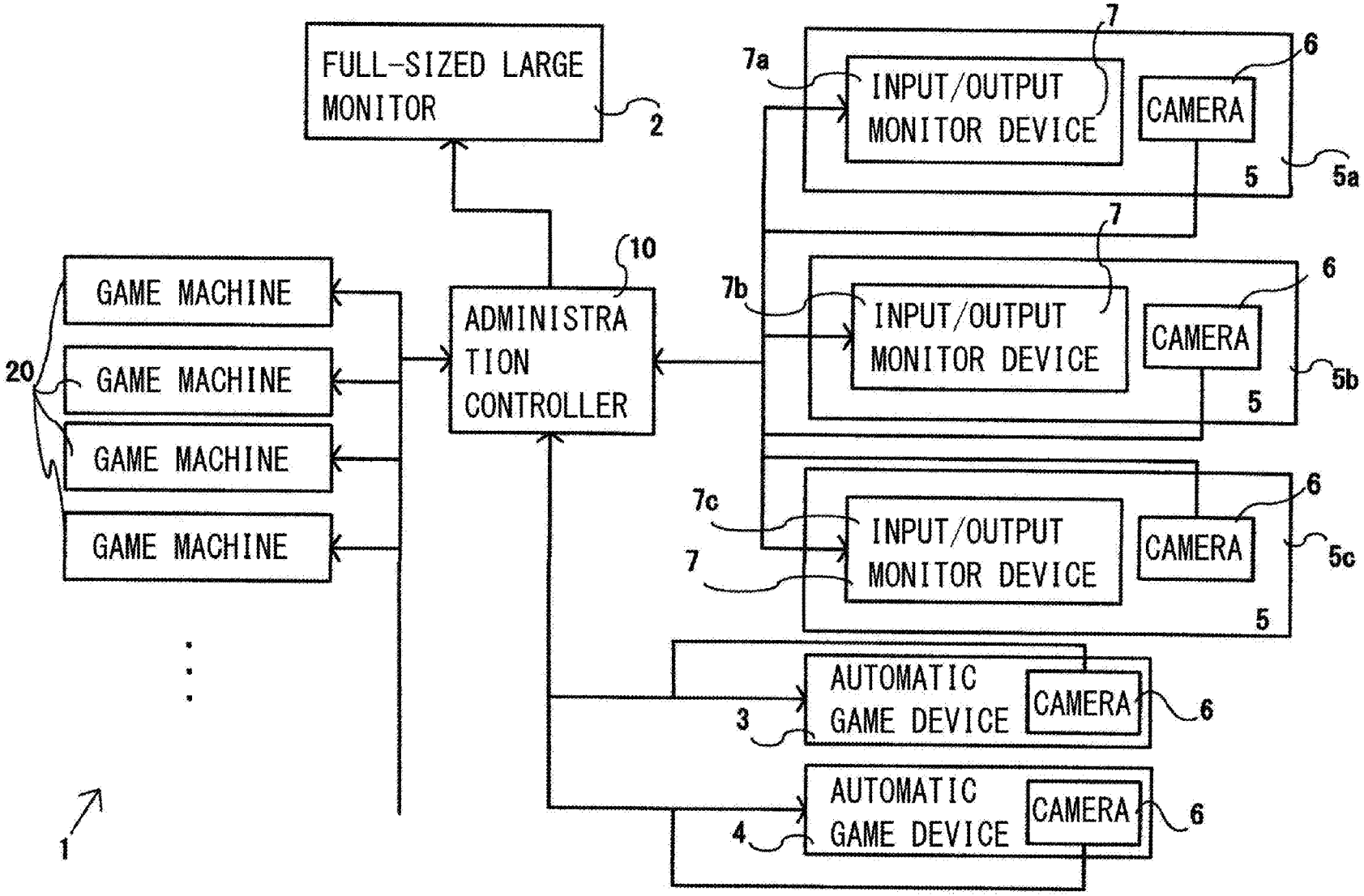
FIG. 2 is a block configuration diagram of the game machine system according to the embodiment.

A configuration of the game machine system 1 will be described with reference to FIGS. 1 and 2. FIG. 1 is an entire schematic perspective view of the game machine system 1 according to the embodiment. FIG. 2 is a block configuration diagram of the game machine system 1 according to the embodiment.

As shown in FIG. 1, in the game machine system 1, a full-sized large monitor 2 is disposed in a casino parlor, and a plurality of table games 5, a plurality of automatic game devices 3, 4 and a plurality of game machines 20 are arranged.

In this game machine system 1, states of respective games are displayed on the full-sized large monitor 2. A monitor 2*a* displays a bingo game for which an administration controller 10 progresses a game, a monitor 2*b* displays a card game using a card such as baccarat or poker where a dealer progresses a game on tables 5*a*, 5*b*, and 5*c*, and a monitor 2*c* displays a state of a roulette game of the automatic game device 4 or a state of a dice game of the automatic game device 3.

The full-sized large monitor 2 may display the state of a game sequentially without specifying a position.

FIG. 2 shows a block configuration diagram of the game machine system 1. In the game machine system 1, input/output monitor devices 7 (7*a*, 7*b*, 7*c*) of the table games 5 (5*a*, 5*b*, 5*c*), a plurality of the automatic game devices 3, 4, and a plurality of the game machines 20 are connected to the administration controller 10. The administration controller 10 receives data input by a dealer via the input/output monitor devices 7 (7*a*, 7*b*, 7*c*) together with a video from cameras 6 in the table games 5.

Further, the administration controller 10 also transmits and receives input/output signals from the game machines 20. Furthermore, the administration controller 10 also transmits and receives input/output signals from the automatic game devices 3, 4 as well as a video from cameras 6 provided in the automatic game devices 3, 4.

The administration controller 10 processes data from the input/output monitor devices 7, the automatic game devices 3, 4 and the game machines 20 and the video from the cameras 6, and displays them on the full-sized large monitor 2. As the data displayed on the full-sized large monitor 2, statistical data of the results of games performed by the table games 5, the automatic game devices 3, 4, and the game machines 20 is displayed by a table, a graph, or the like.

With reference to FIGS. 3 to 6, configurations of an operating device 50 of the game machine 20 and the game machine 20 will be described.

Figure 3:
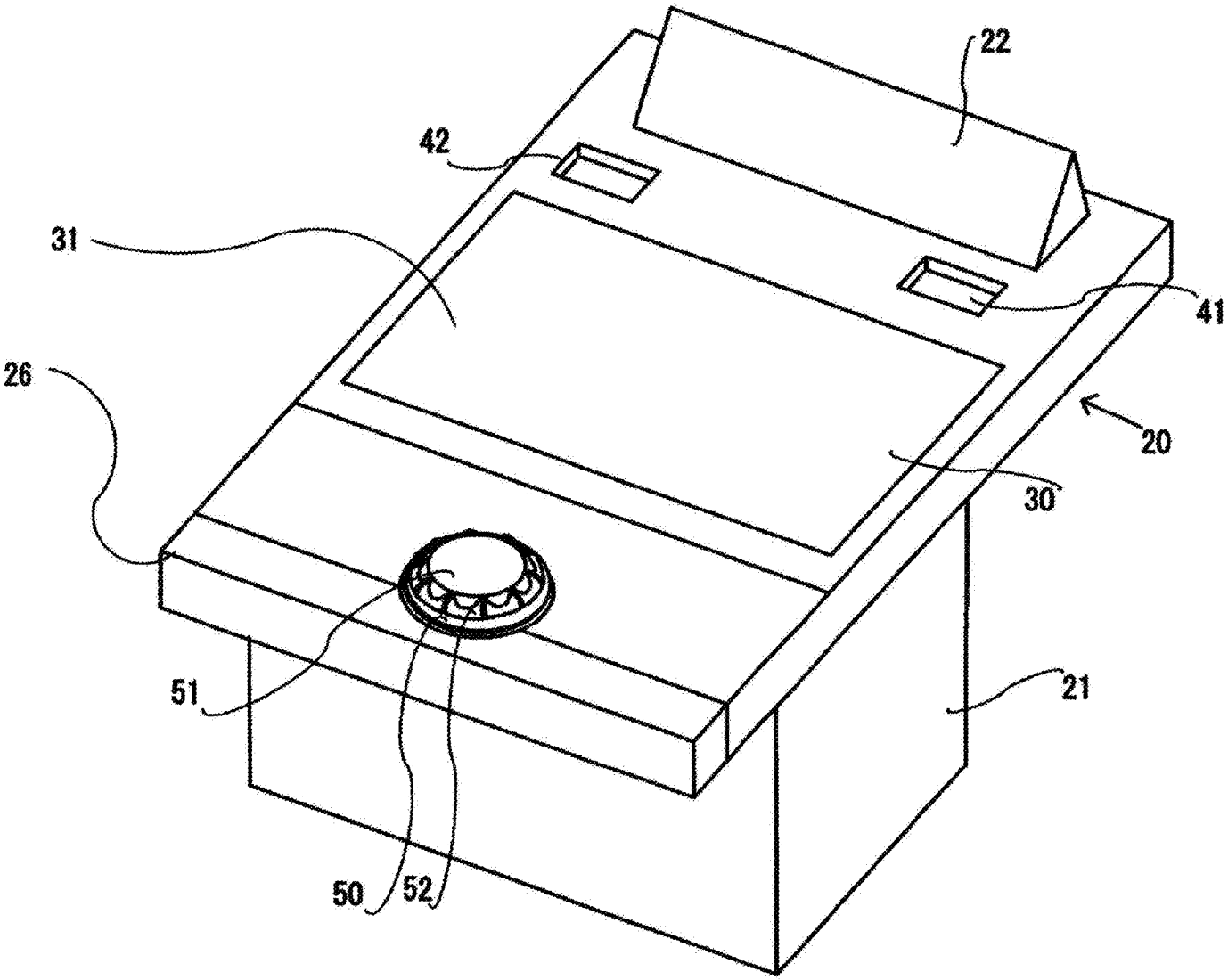
FIG. 3 is a perspective view of a game machine of the game machine system according to the embodiment.
Figure 4:
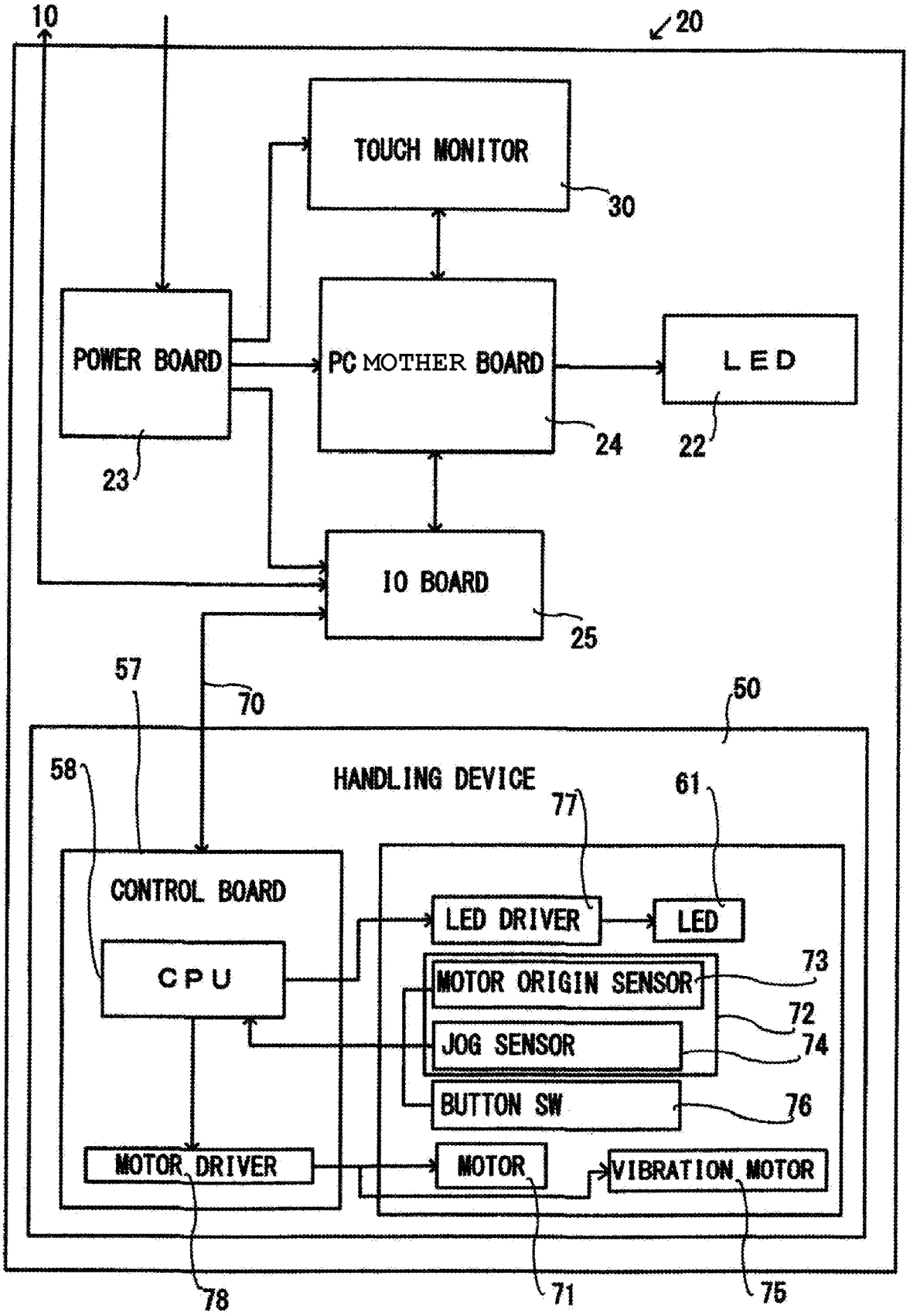
FIG. 4 is a block configuration diagram of the game machine of the game machine system according to the embodiment.
Figure 5:
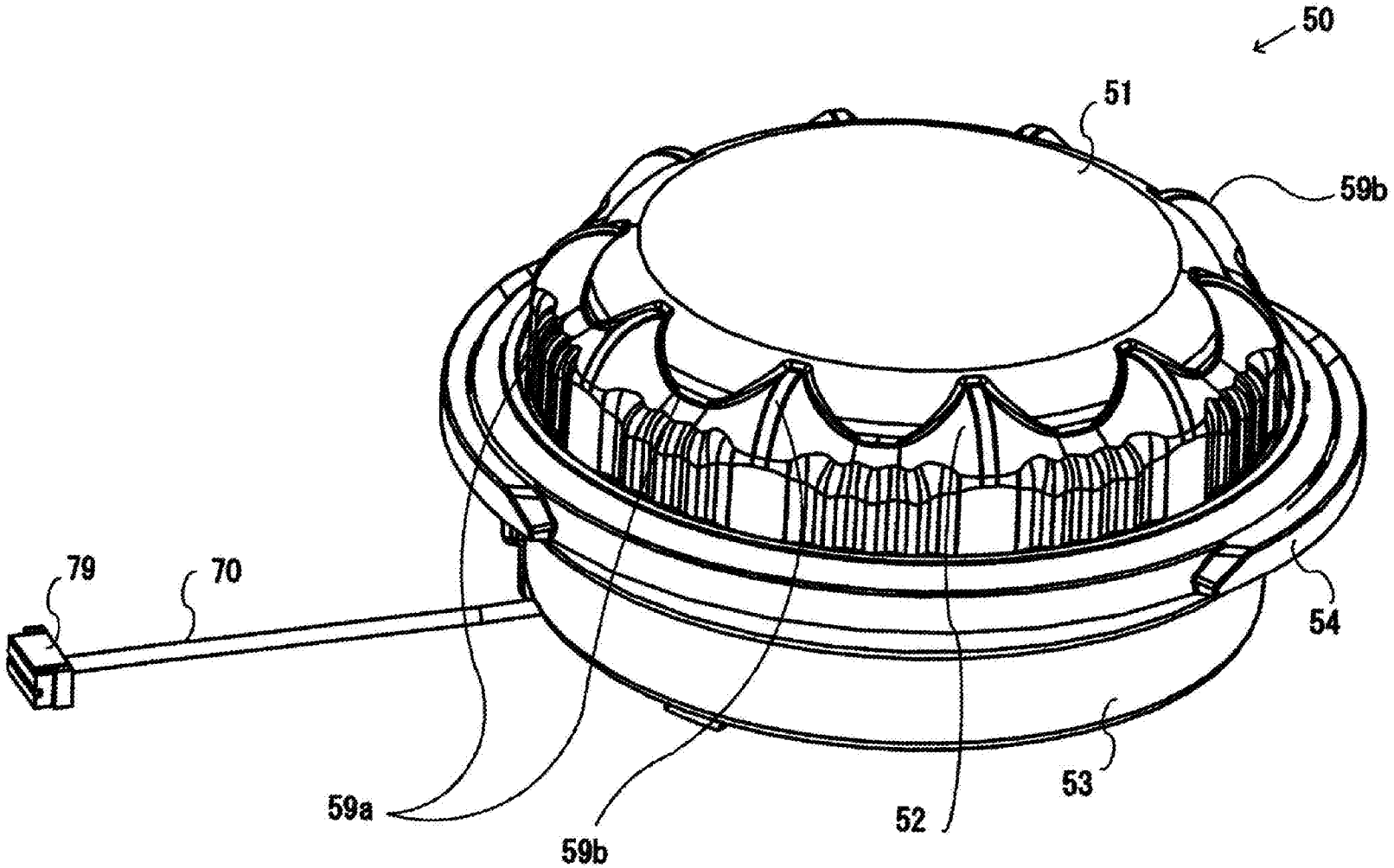
FIG. 5 is a perspective view of an operating device installed in the game machine according to the embodiment.
Figure 6:
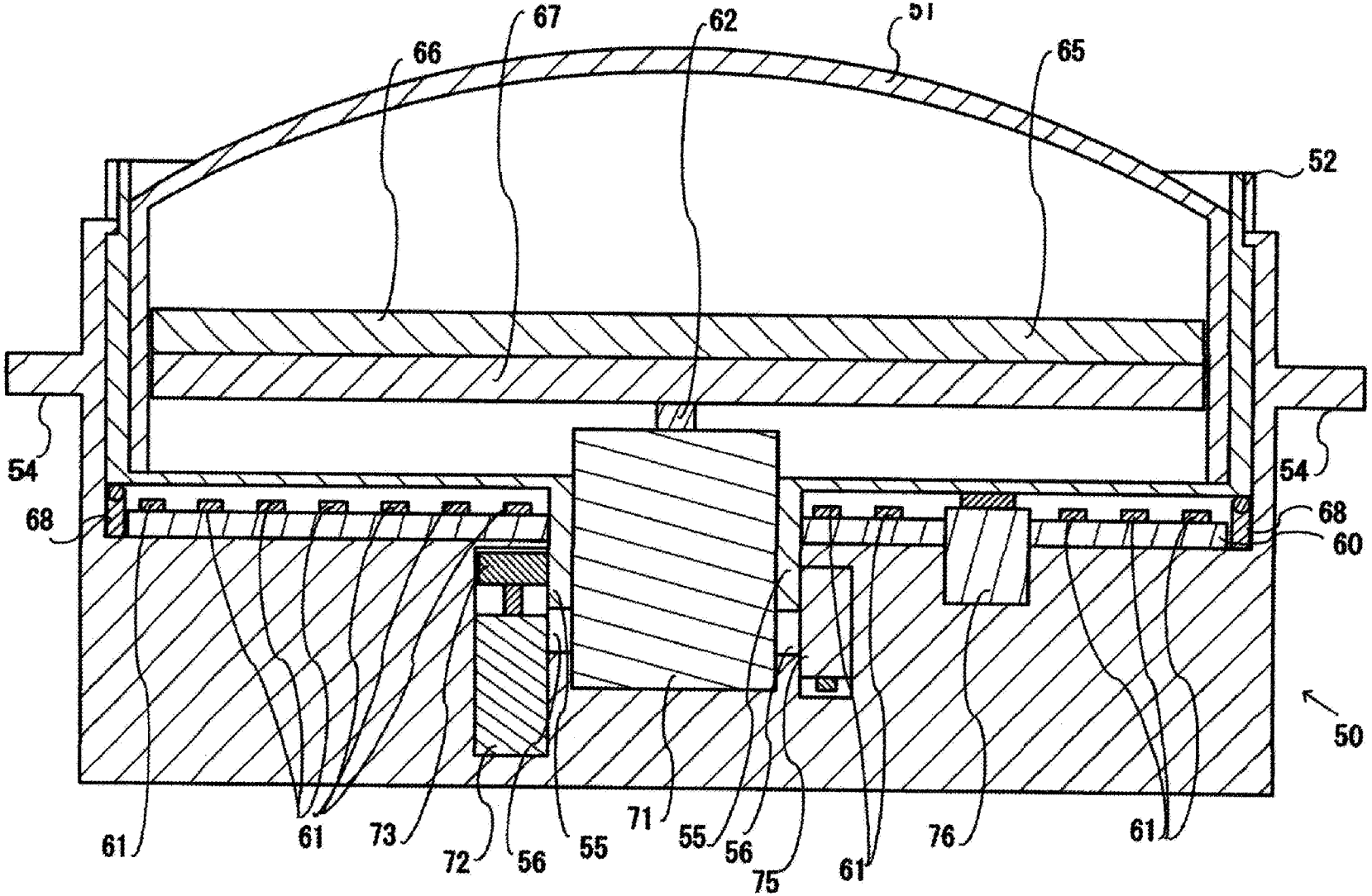
FIG. 6 is a schematic cross-sectional view showing an outline of an internal structure of the operating device installed in the game machine according to the embodiment.

FIG. 3 is a perspective view of the game machine 20 according to the embodiment. FIG. 4 is a block configuration diagram of the game machine 20 according to the embodiment. FIG. 5 is a perspective view of the operating device 50 installed in the game machine 20 according to the embodiment. FIG. 6 is a schematic cross-sectional view showing an outline of an internal structure of the operating device 50 installed in the game machine 20 according to the embodiment.

As shown in FIG. 3, the game machine 20 includes an emergency LED 22 at the uppermost portion, a display portion 30 surrounded by a casing portion 21 at an intermediate portion, and a table 26 protruding at a lower portion. While sitting on a chair (not shown), a player can enjoy a game while operating the operating device 50 provided on the table 26. The game machine 20 further includes a bill acceptor 41 and a ticket printer 42 above the display portion 30. A ticket as a note, which is used in place of a bill and in which the amount of money is written, or a bill can be inserted through the bill acceptor 41, and a ticket on which the amount of payout is written is discharged through the ticket printer 42.

The display portion 30 includes a touch monitor 31 that is of a touch panel type. The number of monitors is not particularly limited and may be three or more, or one, and the monitor may not be of the touch panel type.

The display portion 30 can display on a display screen of the touch monitor 31 a slot machine game or other games such as a table game through communication. The game machine 20 can perform a wide variety of games.

The display portion 30 displays a reel, a payout display portion, a bet display portion, a credit amount display portion, and the like (not shown) on the display screen of the touch monitor 31.

Next, the main configuration of the game machine 20 will be described with reference to the block diagram of FIG. 4. In the game machine 20, each device is operated by a command from a motherboard 24 on which a computer incorporating a hard disk, ROM and RAM is mounted. The game machine 20 controls power supplied from an external power supply with a power supply board 23 and supplies the power from the power supply board 23 to each device.

The motherboard 24 controls the display portion 30 and the emergency LED 22 displayed in case of emergency, and further controls each device via an IO board 25. The IO board 25 is also connected to a speaker (not shown), the bill acceptor 41, the ticket printer 42 (FIG. 3), and the like.

The operating device 50 is connected to the motherboard 24 via a control board 57 incorporating a CPU 58, ROM and RAM, and the IO board 25. The motherboard 24 uses the same CPU, has an OS (operation software), and controls the display portion 30 and the operating device 50, including the IO board.

Under control of the software on the OS driven by the CPU of the motherboard 24, the game machine 20 controls benefit as a state in which a player is advantageous, a stage bonus, and a winning amount of a free game, further controls the display portion 30 reflecting the result obtained from the winning, and furthermore controls the operating device 50.

Using the control program driven by the same OS driven by the same installed CPU of the motherboard 24, the game machine 20 controls lotteries such as benefit, a stage bonus, and benefit of a winning game of a free game, which are advantageous for a player, further controls symbols and a reel (not shown) of the display portion 30, and furthermore controls the operating device 50. Consequently, the control for the display portion 30 can be interlocked with the control for the operating device 50 with less time lag, and, in addition, it is difficult to perform fraudulent acts and the like.

Since the motherboard 24 allows bidirectional communication with the operating device 50 via the IO board 25, the motherboard 24 can be easily connected and easily interlock with the operating device 50, and skipping of data from the operating device 50 due to electrical noise is also reduced. The control program is provided with a notifying control program that operates a notifying control portion to be described later and an operating device control program that controls the operating device 50. The IO board 25 is connected to the administration controller 10, and transmits and receives signals to/from the administration controller 10.

The operating device 50 is connected to the motherboard 24 via the control board 57 incorporating the CPU 58, ROM and RAM, and the IO board 25. The motherboard 24 controls a motor 71 via a motor driver 78 of the control board 57 and further controls lighting of an LED 61 provided in a light source portion 60 shown in FIG. 6 and emission color of the LED 61 via an LED driver 77. The LED 61 uses a monochromatic or full color LED.

In the operating device 50, a rotation operation detecting portion 72 detects a rotation direction and a rotation speed with an origin detecting portion 73 and a jog sensor 74, and further detects whether or not a push button portion 51 is pushed by a button switch 76. The detected data is output to the mother board 24 via the IO board 25.

Next, the appearance of the operating device 50 will be described with reference to FIG. 5. The operating device 50 is provided with a push button portion 51 whose upper portion is flat, transparent and curved on an arc that is easy for a player to place the palm thereon. The operating device 50 is further provided with, on the side of the push button portion 51, a rotation operation portion 52 which has a cutout circular arc portion 59*a* having a circular arc cutout and a circular arc protruding portion 59*b* protruding in an arc shape around the outer circumference. The rotation operation portion 52 has a shape such that a finger is hooked on the cutout circular arc portion 59*a* and the circular arc protruding portion 59*b* during rotation. The push button portion 51 and the rotation operation portion 52 are integrally configured, are depressed in conjunction with push operation, and rotate together with rotation operation.

In the operating device 50, a flange portion 54 is provided, and a body portion 53 incorporating the control board 57 (FIG. 4) and the light source portion 60 (FIG. 6) is provided below the flange portion 54. In the operating device 50, a portion below the flange portion 54 is housed inside the table 26 and fixed to the table 26. A USB terminal 79 is provided at the tip of a cable 70 so as to be capable of being electrically connected to the IO board 25 or the motherboard 24.

Next, the internal structure of the operating device 50 will be described with reference to FIGS. 4 to 6. The operating device 50 is provided with the push button portion 51 whose upper portion is transparent and curved, and the side portion of the push button portion 51 is integrally fixed with the rotation operation portion 52. In addition, a rotation driving portion 65 is provided in a space below the push button portion 51.

The rotation driving portion 65 integrally fixes a decoration display portion 66 and a rotation fixing portion 67, and fixes the motor 71, which pivotally supports the rotation fixing portion 67 on a shaft 62, to the center of the body portion 53. In the rotation driving portion 65, the decoration display portion 66 can be rotated by the rotation of the motor 71. In the decoration display portion 66, any of a pattern, a symbol and a character, or a combination thereof is engraved, printed, or three-dimensionally formed.

In the rotation operation portion 52 integrally formed with the push button portion 51, a rotation shaft 55 is provided so as to be rotatable around the motor. The body portion 53 is provided with an urging means 56 that includes an urging spring, rubber or the like and that is provided below the rotation shaft 55, and the urging means 56 urges the rotation operation portion 52 upward. The body portion 53 is further provided with a ball urging receiver 68 so that the rotation operation portion 52 can be stably rotated and depressed.

The ball urging receiver 68 has a rotary sphere therein and slides with the rotation operation portion 52, and the rotary sphere rotates in accordance with the rotation of the rotation operation portion 52. For the ball urging receiver 68, an urging means (not shown) similar to the above-described urging means is provided so that the rotary sphere moves upward and downward in conjunction with the up-and-down movement of the rotation operation portion 52.

When the push button portion 51 is pushed, the rotation operation portion 52 moves downward and pushes the button switch 76 to detect whether or not the push button portion 51 is pushed. As the button switch 76, a mechanical switch, an optical switch, or the like is used.

The body portion 53 is provided with the light source portion 60 below the rotation operation portion 52. The light source portion 60 includes a plurality of LEDs 61 and transmits the transparent rotation operation portion 52 to illuminate the decoration display portion 66 and the like.

The rotation operation detecting portion 72 abuts against the rotation shaft 55 of the rotation operation portion 52, and when the origin detecting portion 73 rotates in conjunction with the rotation shaft 55, the rotation operation detecting portion 72 detects the number of rotations. The origin detecting portion 73 serves as the jog sensor 74 which detects the rotation direction. Although the jog sensor 74 may serve as the origin detecting portion 73 as in the present embodiment, a sensor which detects the rotation direction may be provided separately.

In the rotation operation portion 52, a vibration motor 75 is provided in an abutted state in order to notify a player that it is advantageous for the player during performance by vibration of the rotation operation portion 52.

Example 1

Next, a performance using the operating device 50 will be described with reference to FIG. 6 and FIGS. 7A and 7B. Example 1 shows a case where a notifying control portion to notify beforehand that it is advantageous for a player while a game is in progress is operated and shows a case of alarming that it is advantageous for a player while a game is in progress. An example of the state in which it is advantageous for a player includes payment of a large dividend, a bonus stage, high odds, and a state in which a free game is won, and the example can be applied to other examples besides this example.

Figure 7A:
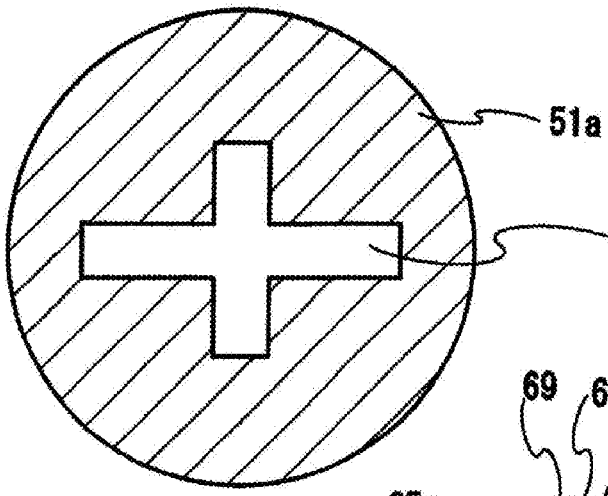
FIGS. 7A to 7E each show an explanatory view of an operating device of a game machine for illustrating Examples 1 and 2 of the embodiment.
Figure 7E:
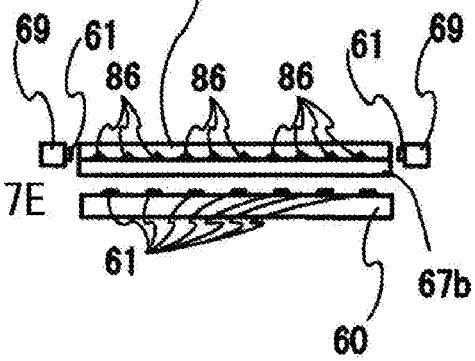
Figure 7B:
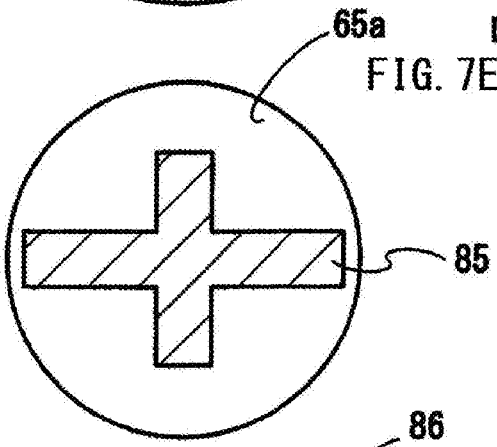
Figure 7C:
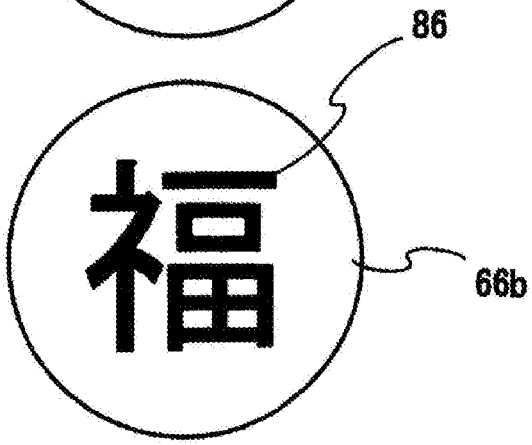
Figure 7D:
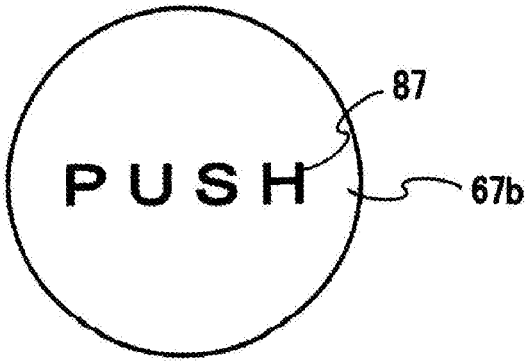

In this example, as shown in FIGS. 6 and 7B, a rotation driving portion 65*a* rotates, and a pattern of a cross 85 is colored, or the decoration display portion 66 formed three-dimensionally is provided. Other portions are transparent so that the light from the light source portion 60 can transmit.

In the push button portion 51, as shown in FIGS. 6 and 7A, a transparent cross 84 having the same shape and size as the cross 85 is formed, and other portions are printed or sealed so that the light from the light source portion 60 provided below does not leak out.

As described above, in the transparent cross 84, the rotation driving portion 65*a* rotates in accordance with the progress of a game, so that the light from the light source portion 60 provided below the transparent cross 84 can be visually recognized, like a beautiful kaleidoscope. The rotating motion seen through the transparent cross 84 can provide a performance giving a sense of expectation to a player.

Example 2

Next, a performance using the operating device 50 will be described with reference to FIG. 6 and FIGS. 7C to 7E. Example 2 shows a case where a display prompting a player to push the push button portion 51 is performed so as to allow the player to participate in a game while the game is in progress, a case where a notifying control portion to notify beforehand that it is advantageous for a player while a game is in progress is operated, and a case of alarming that the game machine 20 is selected by the administration controller 10.

In this example, instead of the motor 71 of the rotation driving portion 65*a*, decoration display portions 66*b* and 67*b* are changed in two modes.

FIG. 7E is a schematic view showing portions of the decoration display portions 66*b* and 67*b* from the side. In the decoration display portion 66*b*, the letter "Fuku" (a Chinese character) is engraved on a transparent light guide plate by a light guide portion 86, and the letter is reflected from the side by the light from the LED 61 provided in a side light source portion 69 so that the letter appears.

On the other hand, in the lower decoration display portion 67*b* in close contact with the decoration display portion 66*b* is printed such that the letter "PUSH" is capable of transmitting the light from the LED 61 of the light source portion 60 provided below, and other portions are printed in black and shield the light. As described above, in the decoration display portions 66*b* and 67*b*, a different letter appears by changing the light emitting portion of the LED 61.

The player is encouraged to push the operating device 50 thus configured, so that the player can participate in and enjoy the game. In addition, two different displays are possible even in the operating device 50 with a thin thickness.

Example 3

In Example 3, as shown in FIGS. 1 to 3 and FIG. 8B, a player participates in the table game 5, and a result of the game is displayed on the touch monitor 31. In the game machine system 1, the game machine 20 and the input/output monitor device 7 can instruct each other by bidirectional communication. Example 3 shows a state in which cards 96 are arranged to the table of the table game 5 from the camera 6 of the table game 5 displayed on the touch monitor 31.

In the operation of the operating device 50 of the game machine 20, the same operation screen is reflected on the input/output monitor device 7. A dealer progresses the game according to instructions from the game machine 20 while watching the input/output monitor device 7 of the game machine 20.

In the game machine system 1, although a player can participate in the same table game 5 or the same automatic game devices 3, 4 from a plurality of the game machines 20, the administration controller 10 selects one of the game machines 20 for which the largest amount of credit is bet in the same game from among the same table game 5 or the same automatic game devices 3, 4, and only one game machine 20 selected can instruct and operate the input/output monitor device 7 or the automatic game devices 3, 4 by the operating device 50.

Here, the selected game machine 20 is displayed on the touch monitor 31 in order to make the player recognize that the game machine 20 is selected, or the emergency LED 22 is displayed in seven colors, whereby the selected game machine 20 can be informed to not only the player but also the dealer and other players.

On the other hand, the game machine 20 causes the light source portion 60 (FIG. 6) of the operating device 50 to emit light, so that the selected game machine 20 can be informed only to the player without being informed to other players. Further, by vibrating the push button portion 51 of the operating device 50, the selected game machine 20 can be informed only to the player without being informed to other players. Furthermore, by rotating the rotation driving portion 65*a*, the selected game machine 20 can be informed only to the player without being informed to other players.

In the game machine 20, as described above, although the administration controller 10 selects the game machine 20 operating the progress in the same game, the game machine 20 may be selected from the input/output monitor device 7 by the dealer.

As described above, even with the game machine 20 at a remote place, since the result is reflected by the player's will as well as a sense of superiority, the player can fully enjoy the atmosphere in which the player participates in the game.

Figure 8B:
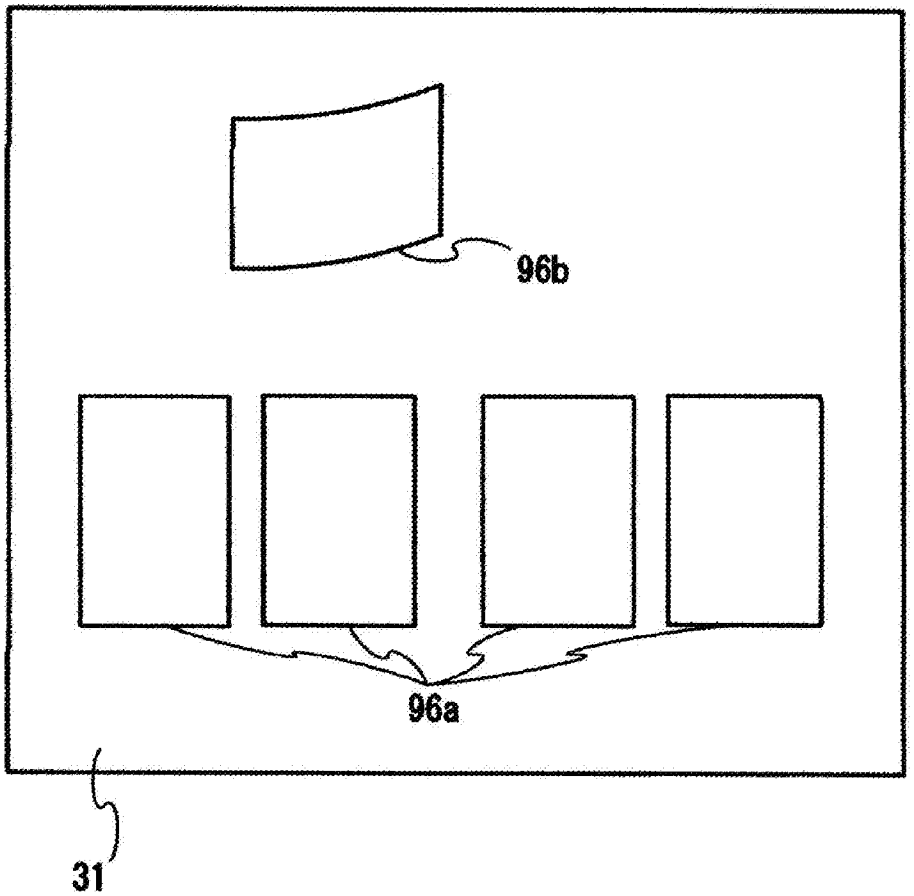
FIGS. 8A and 8B each show a display image of a display portion of a game machine for illustrating Example 3 of the embodiment.

As shown in FIG. 8B, cards 96*a* whose surface with a number described appears are arranged, and such a display that the game result is decided by the last one card 96*b* appears on the display screen.

Figure 8A:
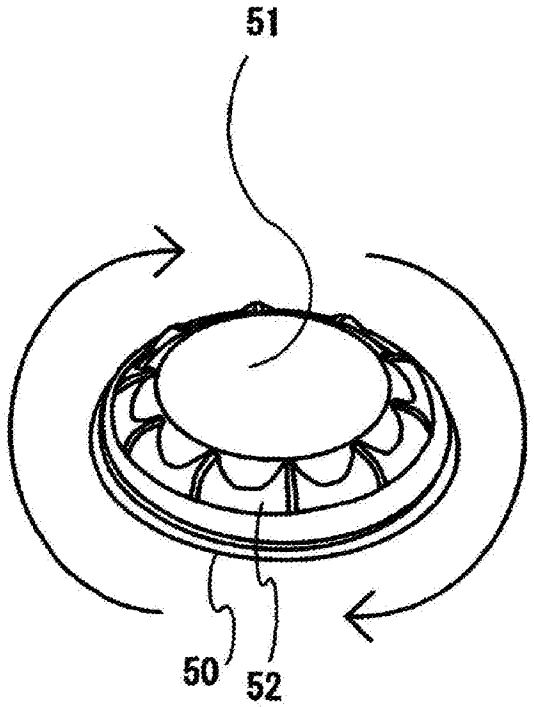

When the rotation operation portion 52 of the operating device 50 is rotated as shown in FIG. 8A, such a mode is displayed that the card 96*b* is turned as shown in FIG. 8B when the rotation operation portion 52 is rotated to the right, and the card 96*b* is returned when the rotation operation portion 52 is rotated to the left. By depressing the push button portion 51, there is a performance that the card 96*b* is turned and the game result is displayed.

As described above, the player can participate in the game as though the player himself turns the card 96*b*. In addition, the player can participate in the game with a sense of expectation of the game result.

Example 4

In Example 4, as shown in FIGS. 1 to 3 and FIG. 9, a player participates in the automatic game device 4, and the game result is displayed on the touch monitor 31. In the game machine system 1, the game machine 20 and the automatic game device 4 can instruct each other by bidirectional communication. The operating device 50 and the touch monitor 31 are interlocked. In the following game machine system 1, the method of selecting one of the game machines 20 is as described above.

As shown in FIGS. 1 to 3 and 9A, first, when the game machine system 1 rotates the rotation operation portion 52 of the operating device 50 of the game machine 20, the game machine system 1 transmits a signal for rotating a roulette 101 of the automatic game device 4 via the administration controller 10. The display screen of the touch monitor 31 displays a state in which the roulette 101 of the automatic game device 4 captured from the camera 6 (FIG. 2) rotates.

As shown in FIGS. 1, 3 and 9B, by depressing the push button portion 51, the game machine system 1 transmits a signal for throwing a ball 102 into the roulette 101 via the administration controller 10. When a predetermined time elapses, the roulette 101 is stopped, and the game result is displayed on the touch monitor 31 or the full-sized large monitor 2.

In the game machine 20 which has not been selected, after the player bets a credit for the automatic game device 4, the player cannot operate the operating device 50 of the automatic game device 4, but can see the state of the game from the touch monitor 31.

The roulette may be interlocked with the actual table game 5, and as described above, in conjunction with the input/output monitor device 7, the progress of the game may be instructed from the game machine 20 instead of the dealer.

Next, with reference to FIGS. 1 to 3 and 9C, there is shown a game in which a dealer receives an instruction from the game machine 20 on the input/output monitor device 7, and the dealer rotates a wheel 105.

The wheel 105 with a number described is displayed on the touch monitor 31, and when a player of the selected game machine 20 rotates the rotation operation portion 52 of the operating device 50, the dealer rotates the wheel 105 and pushes the push button portion 51, so that the game result is displayed. The wheel 105 may be a device that operates automatically.

As shown in FIGS. 1 to 3 and 9D, when the game machine system 1 rotates the rotation operation portion 52 of the operating device 50 of the game machine 20, the game machine system 1 transmits a signal for rolling a dice 107 to the automatic game device 3 via the administration controller 10. Then, when the player of the selected game machine 20 rotates the rotation operation portion 52 of the operating device 50, the dice 107 rolls. When the dice 107 stops, the video from the camera 6 is displayed on the touch monitor 31, and at the same time, the game result is also displayed.

As described above, the player can be prevented from being bored by displaying the other table games 5 and the performances of the automatic game devices 3 and 4 on the touch monitor 31, and the player can participate in and enjoy the game by operating the operating device 50.

Example 5

Figure 10:
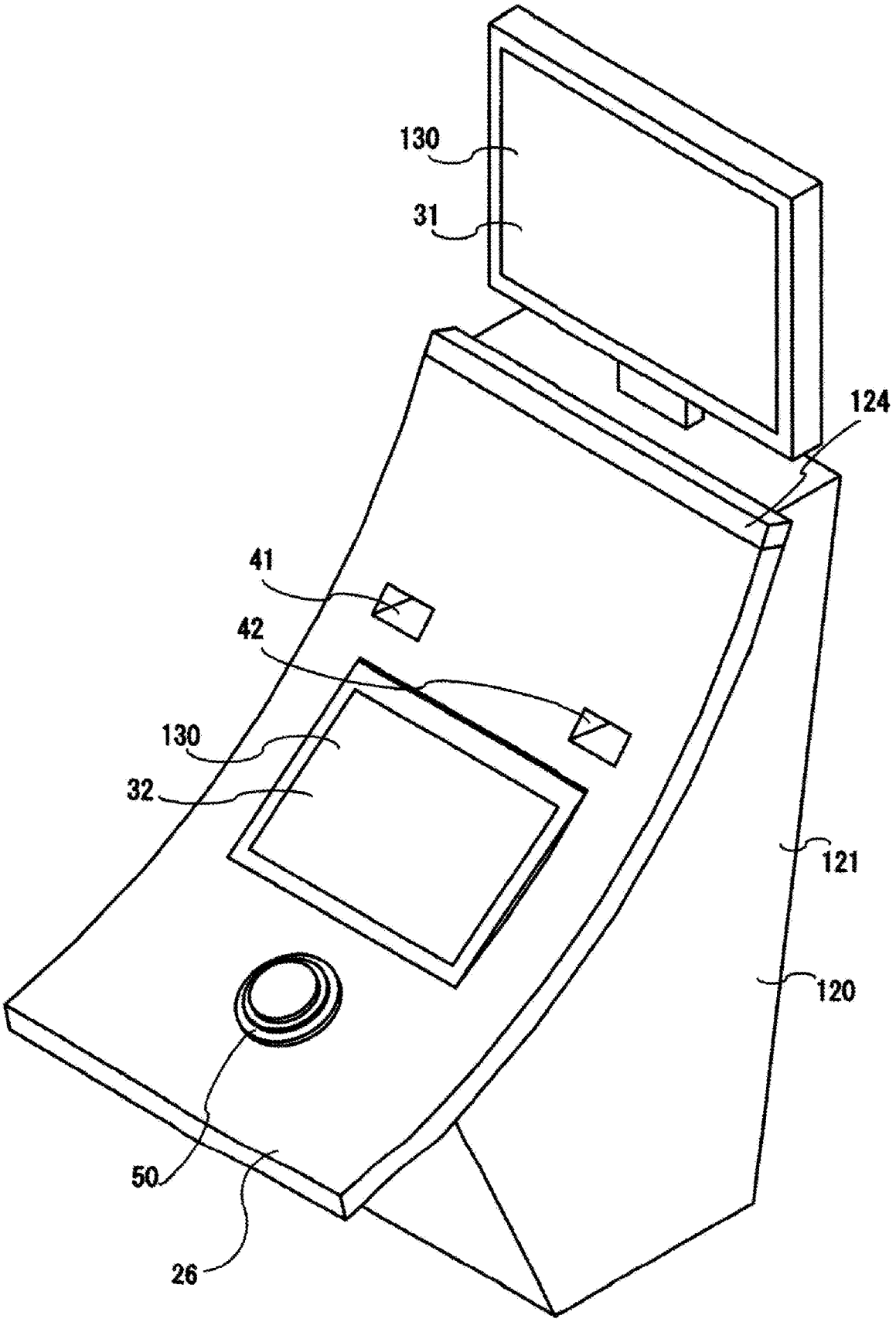
FIG. 10 is a schematic diagram of a game machine for illustrating Example 5 of the embodiment.

FIG. 10 shows another embodiment of the game machine 20 described above. As shown in FIG. 10, a game machine 120 includes the touch monitor 31 that is of a touch panel type as a display portion 130 at the uppermost portion, an emergency LED 124 below the touch monitor 31, a touch monitor 32 as the display portion 130 surrounded by a casing portion 121 at an intermediate portion, and the table 26 protruding downward.

While sitting on a chair (not shown), a player can enjoy a game while operating the operating device 50 provided on the table 26. The game machine 120 further includes the bill acceptor 41 and the ticket printer 42 above the touch monitor 32. A card as a note, which is used in place of a bill and in which the amount of money is written, or a bill can be inserted through the bill acceptor 41, and a card on which the amount of payout is written is discharged through the ticket printer 42.

The display portion 130 includes the monitor 31 and the touch monitor 32 that is of a touch panel type. The number of monitors is not particularly limited and may be three or more, or one. The monitor may not be of the touch panel type.

The display portion 130 can display on display screens of the touch monitors 31 and 32 a slot machine game or other games such as a table game through communication. Thus, the game machine 120 can perform a wide variety of games.

The display portion 130 displays on the display screen of the touch monitor 32 a game currently being played by a player and, for example, displays a reel, a payout display portion, a bet display portion, a credit amount display portion, and the like (not shown).

The display portion 130 may display on the display screen of the touch monitor 31 the progress status or the result of the table game 5 and any of the games of the plurality of automatic game devices 3, 4 via the administration controller 10. Also in this example, the player can participate in and enjoy the other table games 5 and the games of the plurality of automatic game devices 3, 4 and the like by operating the operating device 50 as described above.

Example 6

Figure 11:
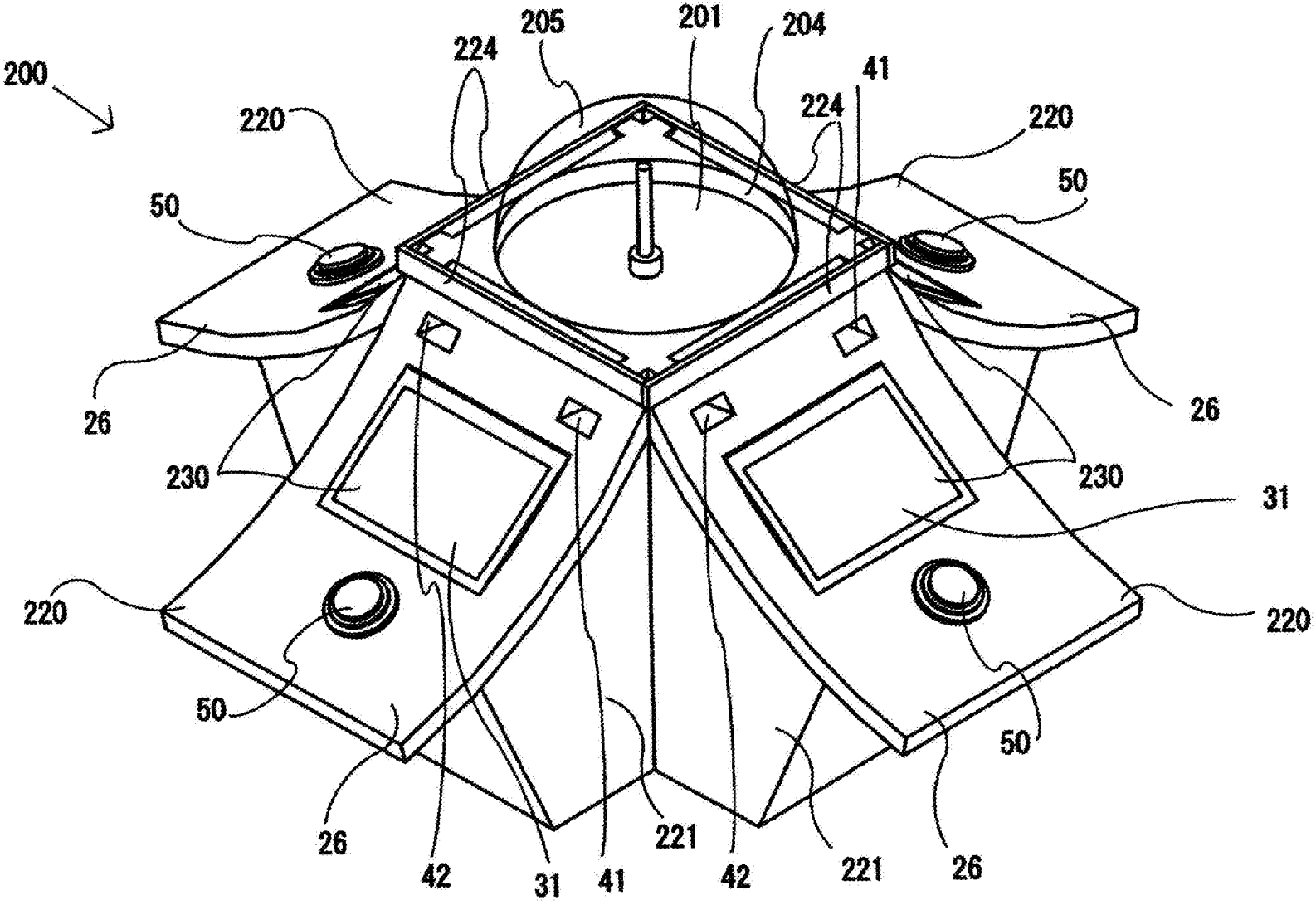
FIG. 11 is a schematic diagram of a game machine for illustrating Example 6 of the embodiment.

FIG. 11 shows another embodiment of the game machine 20 described above. As shown in FIG. 11, an integrated game machine 200 includes in its center an automatic game device 201 capable of providing a roulette game. The automatic game device 201 includes a dome 205 covered in the shape of a dome with transparent glass or the like, a roulette 204 automatically rotates and stops inside, and a ball is automatically thrown and collected.

Four game machines 220 capable of playing the game of the automatic game device 201 are provided around the automatic game device 201.

The game machine 220 includes an emergency LED 224 at the uppermost portion and the monitor 31 that is of a touch panel type as a display portion 230 at an intermediate portion therebelow. The touch monitor 31 is surrounded by a casing portion 221, and in the game machine 220, the table 26 protrudes downward. The number of monitors is not particularly limited and may be three or more, or one. The monitor may not be of the touch panel type.

While sitting on a chair (not shown), a player can enjoy a game while operating the operating device 50 provided on the table 26.

The game machine 220 further includes the bill acceptor 41 and the ticket printer 42. A card as a note, which is used in place of a bill and in which the amount of money is written, can be inserted through the bill acceptor 41, and a card on which the amount of payout is written is discharged through the ticket printer 42.

The display portion 230 displays on a display screen of the touch monitor 31 the video from the camera 6 (not shown) capturing the state of the automatic game device 201 and, at the same time, displays a payout display portion, a bet display portion, a credit amount display portion, and the like so as to allow participation in the game.

In addition, the display portion 230 can display a slot machine game or other games such as a table game through communication. Thus, the game machine 220 can perform a wide variety of games.

The display portion 230 may display on the display screen of the touch monitor 31 the progress status or the result of the table game 5 and any of the games of the plurality of automatic game devices 3, 4 via the administration controller 10.

Also in this example, the player can participate in and enjoy the other table games 5 and the games of the plurality of automatic game devices 3, 4 and the like by operating the operating device 50 as described above.

Example 7

Figure 12A:
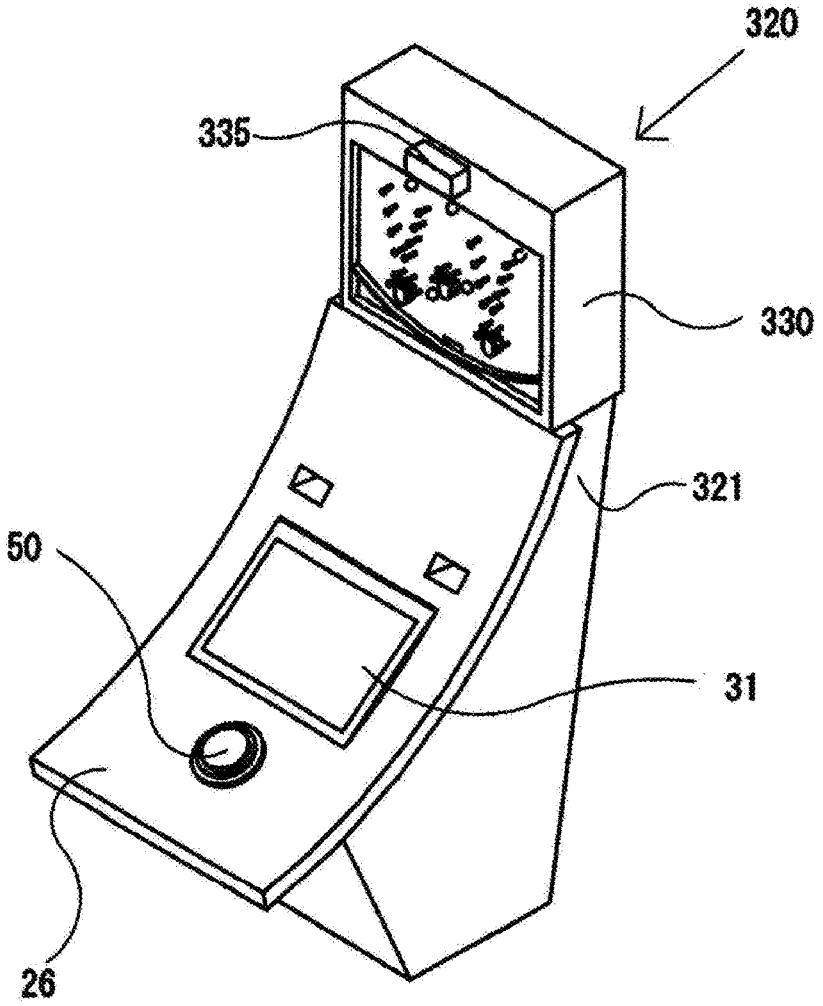
FIGS. 12A and 12B each show a schematic diagram of a game machine for illustrating Example 7 of the embodiment.

FIG. 12 shows another embodiment of the game machine 20 described above. As shown in FIG. 12, a game machine 320 can perform a slot machine. The game machine 320 includes at its uppermost portion a pachinko device 330 that can make a player enjoy a bonus stage won by the slot machine.

In the game machine 320, the touch monitor 31 is provided below the pachinko device 330 and surrounded by a casing portion 321, and the table 26 protrudes downward. While sitting on a chair (not shown), a player can enjoy a game while operating the operating device 50 provided on the table 26.

Figure 12B:
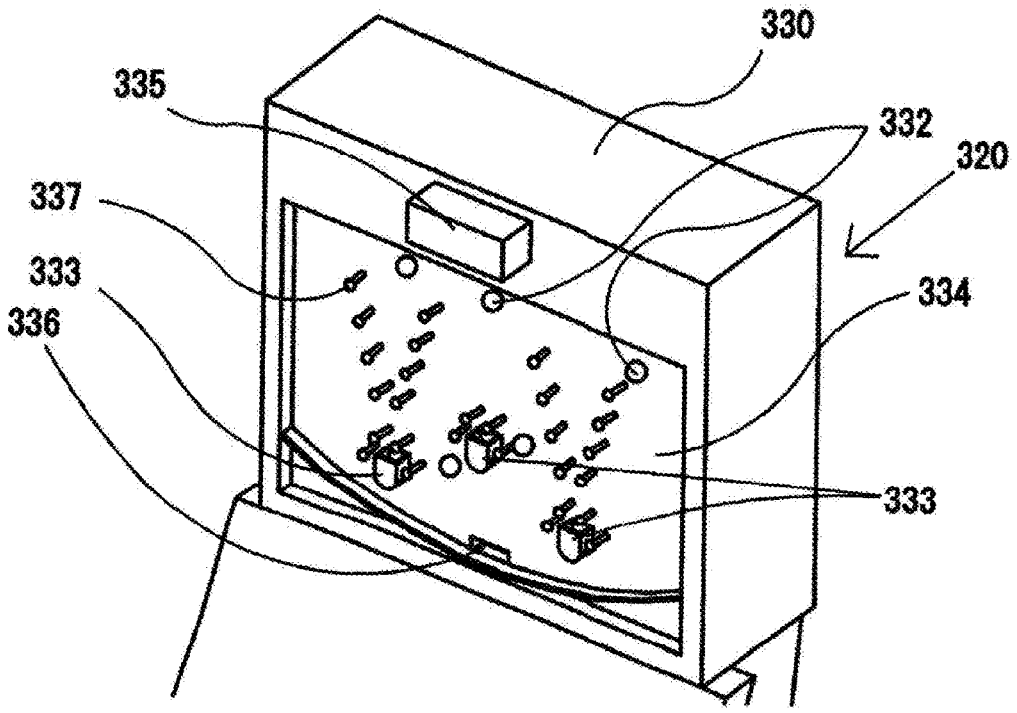

The pachinko device 330 shown in FIG. 12B includes a plurality of nails 337 arranged on a board surface 334, a plurality of winning devices 333, and a plurality of pachinko balls 332. Although not shown, the pachinko device 330 incorporates a ball polishing lifting device which conveys upward the pachinko balls 332 dropped while polishing the pachinko balls 332.

The pachinko device 330 includes on its upper portion an imaging portion 335 having a built-in camera that images the board surface 334, and images the state of the pachinko balls 332 rolling on the board surface 334. The imaging portion 335 is equipped with a magnetic sensor, an acceleration sensor, and the like. The imaging portion 335 is used not only in enjoying the state of the game, but also in an abnormality such as fraudulent acts or a test for an error from an initial value of the nail 337. In order to maintain fairness, the degree of inclination is periodically checked by the acceleration sensor.

The pachinko device 330 is used by the following game method. When a predetermined number of bonus symbols appear on a display screen of the touch monitor 31, the game machine 320 wins a bonus stage, and the pachinko device 330 drops the pachinko balls 332 from the above. The game machine 320 converts the number of the pachinko balls 332 having entered the winning device 333 and a ball collection port 336 into points, and in a bonus stage, when the total point exceeds a reference value, a double point is obtained. For example, when the pachinko balls 332 have entered the winning device 333, 10 points are obtained, and when the pachinko balls 332 have entered the ball collection port 336, 1 point is obtained.

As described above, since the bonus stage is a game using the pachinko balls 332, the player can enjoy a powerful game unlike a two-dimensional game.

In the above examples, in a case where the rotation operation is prompted during a performance, when the operation of the rotation of the operating device 50 or the depression of the push button portion 51 is not performed for a predetermined time in order to make the progress of the game interesting, the game may be forcibly progressed. For example, the predetermined time is about 10 to 15 seconds, and after taking time to operate, if there is no operation for the progress of the game, the game result may be displayed to proceed to the next game.

As described above, the player can enjoy a game with good tempo without wasting time and without being bored.

REFERENCE NUMERALS

1 Game machine system
2 Full-sized large monitor
2*a*, 2*b*, 2*c* Monitor
3, 4, 201 Automatic game device (dice game, roulette machine)
5, 5*a*, 5*b*, 5*c* Table game
6 Camera
7, 7*a*, 7*b*, 7*c* Input/output monitor device
10 Administration controller
20, 120, 220, 330 Game machine
21 Casing portion
22, 124, 224 Emergency LED
23 Power supply board
24 Motherboard
25 I/O board
26 Table
30, 130 Display portion
31, 32 Touch monitor
41 Bill acceptor
42 Ticket printer
50 Operating device
51 Push button portion
52 Rotation operation portion
53 Body portion
54 Flange portion
55 Rotation shaft
56 Urging means
57 Control board
58 CPU
59*a* Cutout circular arc portion
59*b* Circular arc protruding portion
60 Light source portion
61 LED
62 Shaft
65 Rotation driving portion
66, 66*b*, 67*b* Decoration display portion
67 Rotation fixing portion
68 Ball urging receiver
69 Side light source portion
70 Cable
71 Motor
72 Rotation operation detecting portion
73 Origin detecting portion
74 Jog sensor
75 Vibration motor
76 Button switch
77 LED driver
78 Motor driver
79 USB terminal
84 Transparent cross
85 Cross
86 Light guide portion
96*a*, 96*b* Card
101, 204 Roulette
102 Ball
105 Wheel
107 Dice
108 Coin
200 Integrated game machine
205 Dome
330 Pachinko device
332 Pachinko ball
333 Winning device
334 Board surface
335 Imaging portion
336 Ball collection port
337 Nail.

What is claimed is:

1. A game machine system comprising a game machine capable of progressing different kinds of games and a table game with different kinds of the games, the game machine system comprising:

an administration controller connected to a plurality of the game machines; and the game machine capable of displaying progress of a game selected from a plurality of kinds of games and a result of the game, wherein each of a plurality of the game machines includes an operating device with which a player operates the progress of the game, the administration controller selects one of the game machines among table games or automatic game devices and the selected game machine instructs and operates an input/output monitor device or an automatic game device by the operating device, the progress of the game at a place different from the game machine is performed by operation of the operating device, the game machine causes a light source portion of the operating device to emit light, by vibrating a push button portion of the operating device, or by rotating a rotation driving portion, so that the selected game machine informs only a player of the selected game machine without informing other players.

2. The game machine system according to claim 1, wherein the operating device includes a rotation operation portion that is rotatable by a player in conjunction with a mode displayed on a display portion of the game machine, and a rotation operation detecting portion for detecting a state of rotation operation of the rotation operation portion, and the rotation operation portion includes a depression operation portion capable of deciding the progress of the game when depressed by the player.

3. The game machine system according to claim 1, wherein the administration controller selects the game machine for which a largest amount of credit is bet from among the games of same kind to be connected, and the game is progressed by operation of the operating device of the game machine.

4. The game machine system according to claim 1, wherein the selected game machine includes a decoration light emitting portion for causing at least a portion of the game machine to emit light in a mode different from another game machine.

5. The game machine system according to claim 2, wherein in a game using a card among the games, operation of turning the card or operation of returning the card is displayed on the display portion displaying a mode of the game in conjunction with a rotation operation of the rotation operation portion.

6. The game machine system according to claim 2, wherein in a game using a roulette among the games, a rotation direction of the roulette or a ball throwing direction of the roulette is operated in conjunction with a rotation operation of the rotation operation portion.

7. The game machine system according to claim 2, wherein in the game using a roulette among the games, a ball of the roulette is thrown in response to depression of the depression operation portion.

8. The game machine system according to claim 2, wherein in a game using a dice among the games, the dice is thrown in response to depression of the depression operation portion.

9. The game machine system according to claim 1, wherein the table game includes:

a camera for imaging the progress of the game;

a monitor for displaying a state taken by the camera; and an input device with which a dealer inputs, a signal input from the input device is transmitted to the game machine via the administration controller, and the game machine transmits, to the input device, a content operated via the administration controller by operation of the operating device based on an input result.

10. The game machine system according to claim 2, wherein the table game includes:

a camera for imaging the progress of the game;

a monitor for displaying a state taken by the camera; and an input device with which a dealer inputs, a signal input from the input device is transmitted to the game machine via the administration controller, and the game machine transmits, to the input device, a content operated via the administration controller by operation of the operating device based on an input result.

11. The game machine system according to claim 2, wherein in a wheel game that progresses while a wheel rotates among the games, a rotation operation of the wheel game is performed in response to a rotation operation of the rotation operation portion.

12. The game machine system according to claim 9, wherein the monitor displays a progress status by each of the games and statistical data of a game result of each of the games.

13. The game machine system according to claim 2, wherein in a game machine not selected by the administration controller, a mode to be displayed on the display portion is displayed in conjunction with the rotation operation of the rotation operation portion of the game machine selected by the administration controller.

14. The game machine system according to claim 10, wherein the administration controller displays on the monitor the rotation operation of the rotation operation portion of the game machine selected, simultaneously with the progress of the table game.

15. The game machine system according to claim 6, wherein the game machine automatically throws a ball and includes an automatic game device mounted with a camera capable of judging a result of a game.

16. The game machine system according to claim 8, wherein the game machine automatically throws a dice and includes an automatic game device mounted with a camera capable of judging a result of a game.

* * * * *